US005112290A

United States Patent [19]

Hibsch

[11] Patent Number: 5,112,290

[45] Date of Patent: May 12, 1992

[54] POP-OUT SLIDE AND METHOD OF MAKING SAME

[75] Inventor: Susan Hibsch, Woodridge, Ill.

[73] Assignee: The Lehigh Press, Inc., Cherryhill, N.J.

[21] Appl. No.: 639,107

[22] Filed: Jan. 9, 1991

Related U.S. Application Data

[62] Division of Ser. No. 575,421, Aug. 30, 1990.

[51] Int. Cl.[5] ..... B31D 7/00

[52] U.S. Cl. ..... 493/325; 493/334; 493/944; 493/959; 283/65; 434/405; 40/491

[58] Field of Search ..... 40/488, 490, 491, 508; 493/944, 952, 325, 331, 333, 334, 335, 344, 345, 356, 357, 358, 359, 959; 283/65; 434/198, 199, 405

[56] References Cited

U.S. PATENT DOCUMENTS

| | | | |
|---|---|---|---|
| 889,714 | 6/1908 | McDonald | 40/491 X |
| 1,603,592 | 10/1926 | Glasner . | |
| 1,699,383 | 1/1929 | Taylor . | |
| 1,898,308 | 2/1933 | Miller . | |
| 3,025,767 | 3/1962 | Ruffalo | 493/325 |
| 4,090,313 | 5/1978 | Morse | 40/491 X |
| 4,262,939 | 4/1981 | Schoetle, Jr. | 283/65 |
| 4,349,346 | 9/1982 | Bromberg | 493/944 X |
| 4,913,694 | 3/1990 | Alphenaar et al. | 493/944 X |
| 5,057,067 | 10/1991 | Hibsch | 493/325 |

*Primary Examiner*—Bruce M. Kisliuk
*Assistant Examiner*—John A. Marlom
*Attorney, Agent, or Firm*—Trexler, Bushnell, Giangiorgi & Blackstone, Ltd.

[57] ABSTRACT

A pop-out slide and a method of fabricating the same from a single continuous web of material. The method comprises cutting a web of material to define a through slot and a cutout, such that the cutout in turn defines a pop-out member superimposable with and shaped and alignable for selective extension through the slot, slitting said web into two ribbons, one ribbon including said slot and the other including the cutout and the pop-out member. The method proceeds by stacking the ribbons in a position for aligning the pop-out member with the slot, applying a seam of glue adjacent the slot and marrying the ribbon carrying the pop-out member with the ribbon carrying the slot. Thereafter, the method proceeds by folding over the slot-carrying ribbon so as to fully enclose the ribbon carrying the pop-out member and such that the seam of glue extends through the cutout defining the pop-out member to adhesively secure with a facing surface of the slot-carrying ribbon to the other side thereof.

6 Claims, 3 Drawing Sheets 10
12

10
14
16
18
20
22

10
14
16
18
20
22
24
26
27
28
30

10
14
16
18
20
22
24
26
27
28
30
32
34
36

POP-OUT SLIDE AND METHOD OF MAKING SAME

This is a divisional of copending application Ser. No. 07/575,421, filed on Aug. 30, 1990.

BACKGROUND OF THE INVENTION

This application relates generally to a pop-out slide type of product and to a method for making such a product.

Generally speaking, a pop-out slide is a paper product in which an internal slide member may be manipulated to extend a pop-out member or portion through an opening in a slotted face panel or portion of the construction. As such, the slide portion is generally carried between the slotted face portion and a base portion of the construction. The pop-out slide construction is fabricated from a web of a suitable paper or paper-like material and, in the present invention, preferably from a single web of such material, however, a double-web can also be used.

Various specialty products such as pop-up products and pop-out or slide products are used in various promotional applications. For example, many greeting cards as well as advertising-type material utilize various types of slide-out or pop-up arrangements to enhance appeal both to the purchasing public and/or to advertisers. Often, such advertisements are carried as inserts in newspapers, magazines and periodicals or in advertising brochures, catalogs or the like. While the fabrication of such items may take various forms, it is particularly desirable to minimize the cost thereof and maximize the speed at which such items may be fabricated and printed. Preferably, the printing and fabrication of such a pop-out and/or slide type item takes place in a single press run; that is, on one pass through a single line of equipment.

It is also preferable that the pop-out and/or slide type item be fabricated from an initial single web of material, such as from a single roll of a roll-type paper stock material, which can be readily and conveniently fed in one pass through the necessary printing and forming machinery as a continuous web and at fairly high speed. The cutting of the web into the individual, fully-formed items generally comprises the final step in such a one-pass fabrication procedure. Thereupon the individual items may be suitably stacked or collated for packaging or for insert use as desired.

Such single pass operations, utilizing a single web from a roll or the like may proceed at a relatively high speed, often approaching thousands of pieces per hour, to thereby maximize the production and minimize the cost of such items.

OBJECTS AND SUMMARY OF THE INVENTION

It is a general object of this invention to provide a novel and improved pop-out slide and an improved method of making the same.

A related object is to provide a pop-out slide and method of making the same wherein the pop-out slide may be fabricated in a single pass type of operation from a single continuous web.

Briefly, and in accordance with the foregoing objects, a pop-out slide fabricated from a single continuous web of material comprises a base panel, a slotted panel having a through slot therein and extending to one side of the base panel and defining a fold line therebetween and a slide panel extending from a side of the slotted panel opposite the base panel and having a cutout therethrough which defines a pop-out member shaped and alignable for selective extension through the slot when the slide panel is slit from and superimposed upon the slotted panel. A glue seam on the slotted panel is located and aligned for contacting and engaging the base panel through the cutout when the slotted panel with the slide panel slit therefrom and superimposed thereupon is folded along the base panel so as to slidably engage the slide panel therebetween. The glue seam-engaged portions of the base panel and slotted panel cooperate with the cutout for limiting movement of the slide panel therewithin to a direction for extending and retracting the pop-out member relative to the slot for defining respective limits of bidirectional slidable movement of the slide panel.

A method of fabricating a pop-out slide from a single continuous web of material comprises the steps of cutting the web of material to define a through slot and a cutout, such that the cutout in turn defines a pop-out member superimposable with and shaped and alignable for selective extension through said slot and slitting the web into two ribbons, one ribbon including the slot and the other including the cutout and pop-out member. The ribbons are then stacked in a position for aligning the pop-out member with the slot and a seam of glue is applied adjacent said slot. The ribbon carrying the pop-out member is married with the ribbon carrying the slot and the slot-carrying ribbon is folded over so as to fully enclose the ribbon carrying the pop-out member, and the seam of glue extends through the cutout defining the pop-out member to adhesively secure with a facing surface of the slot-carrying ribbon to the other side thereof.

BRIEF DESCRIPTION OF THE DRAWINGS

The features of the present invention which are believed to be novel are set forth with particularity in the appended claims. The organization and manner of the operation of the invention, together with further objects and advantages thereof may best be understood by reference to the following description, taken in connection with the accompanying drawing in which like reference numerals identify like elements, and in which:

DETAILED DESCRIPTION OF THE ILLUSTRATED EMBODIMENT

Figures 1, 2, 3, 4:
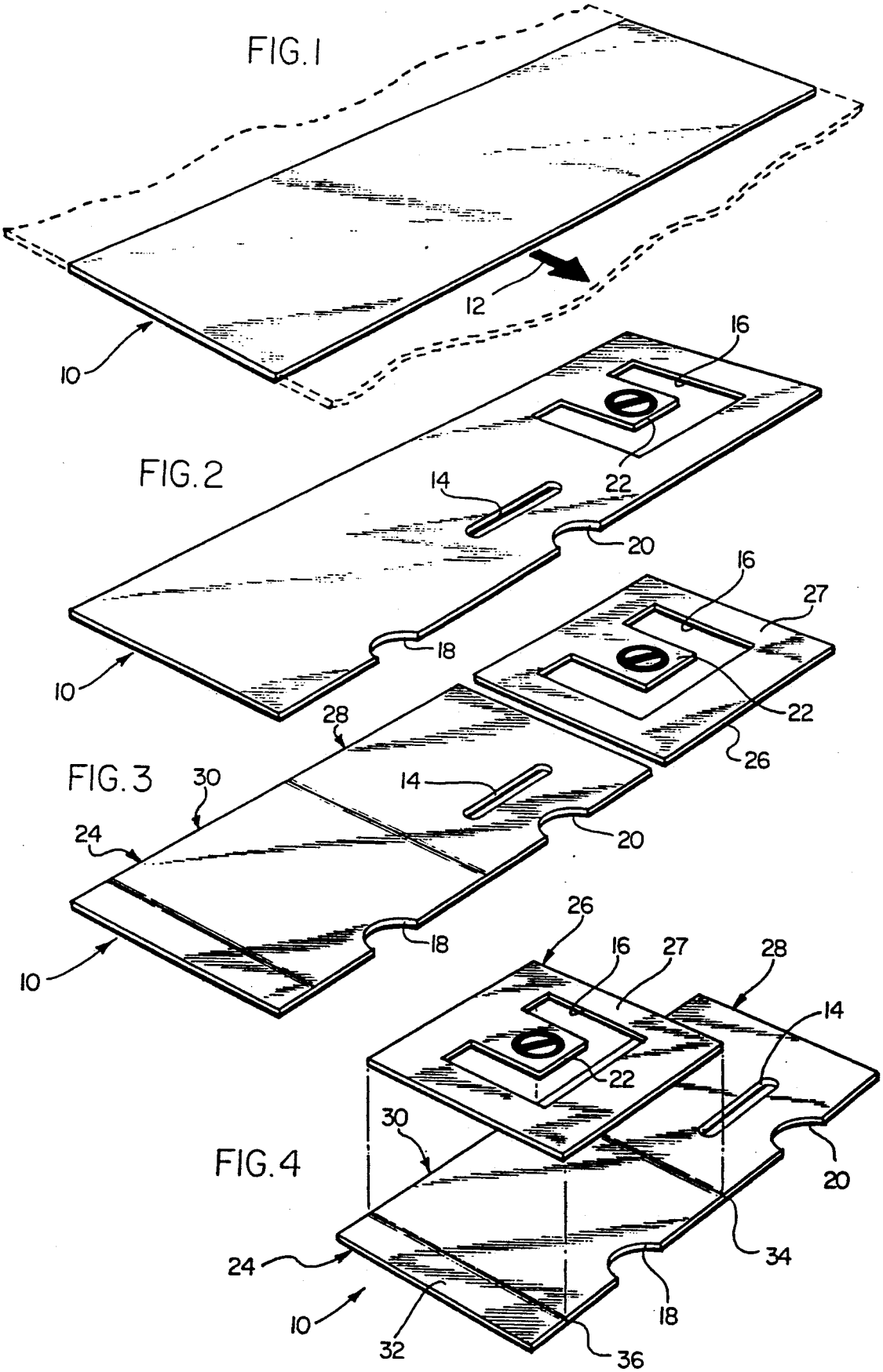
FIG. 1 is a perspective view of a segment of a continuous web of material from which a pop-out slide in accordance with the invention may be fabricated.
FIG. 2 is a perspective view of the web of FIG. 1 illustrating a die cutting step or operation.
FIG. 3 illustrates a slitting step or operation on the web of FIGS. 1 and 2.
FIG. 4 illustrates a stacking step or operation with two ribbons formed pursuant to the slitting operation of FIG. 3.

Referring to the drawings, and initially to FIGS. 1-8, a method of fabricating a pop-out slide in accordance with the invention will be described. The completed pop-out slide, constructed in accordance with the method of the invention, is also shown in FIGS. 8-12, to which reference will be had later herein.

Referring to FIG. 1, a method of fabricating a pop-out slide in accordance with the invention includes the fabrication of the pop-out slide from a single continuous web of material designated generally by the reference numeral 10. This web of material will be understood to be continuous, such that only a single segment thereof is illustrated in FIG. 1. The direction of movement of the material 10 through apparatus for processing the same into a more or less continuous stream of pop-out slide devices is indicated generally by the reference numeral 12. It will be understood that the web segment or portion illustrated in FIG. 1 is but a part of an elongate continuous web of material such as paper or paper-like product which may be carried on a roll, to be fed in direction 12 through a continuous line of equipment for fabricating a continuous series of pop-out slides from the web 10 end-to-end in a one-pass operation. The continuous nature of web 10 has been indicated in broken line in FIG. 1. This showing has been omitted from the remaining drawings to facilitate clarity.

Initially, any printed material to be included on a finished product will be printed upon the desired locations on the web 10. Thereafter, and referring next to FIG. 2, a cutting operation, preferably in the form of a die-cutting operation, is utilized to form additional cut-out portions or slots on the web 10. It will be understood in this regard that FIGS. 2-8 illustrate the formation of but a single pop-out slide on the illustrated portion or segment of the web 10; however the process is continuous so that a plurality of identical pop-out slides will be formed in end-to-end fashion on the continuous web 10.

In FIG. 2, the die-cutting operation forms a first through opening or slot 14 which is located generally in a central portion of the web and a second through opening or cutout 16 which is located to one side of slot 14 in the illustrated embodiment. Preferably additional edge cutouts or thumb tab cutouts 18, 20 are also formed in appropriate portions of the web. As will be seen later, the thumb tab cutouts permit gripping and manipulation of a panel which carries a pop-out portion of the finished product in use.

The cutout 16 defines a pop-out member 22 and this pop-out member is superimposable with and also shaped and alignable for selective extension through the slot 14 when the pop-out slide is completed as will be described further hereinbelow.

Referring next to FIG. 3, the method next proceeds by slitting the web 10 into two ribbons 24, 26, the ribbon 24 including the slot 14 and the ribbon 26 including the cutout 16. As will be more fully appreciated later, the formation of the thumb tab cutouts 18 and 20, of the slot 14, and of the cutout 16, and the slitting of the two ribbons generally define three panels on the two ribbons 24, 26. One of these panels, designated as the slide panel 27, is generally defined on the ribbon 26. A second panel, which will be called the slotted panel 28, is that area or portion which carries the slot 14. The slide panel generally extends from one side of the slotted panel prior to its severing or slitting therefrom as illustrated in FIG. 3. A third panel, which will be referred to as the base panel 30, extends generally to the opposite side of the slotted panel from the slide panel 27.

Figure 5:
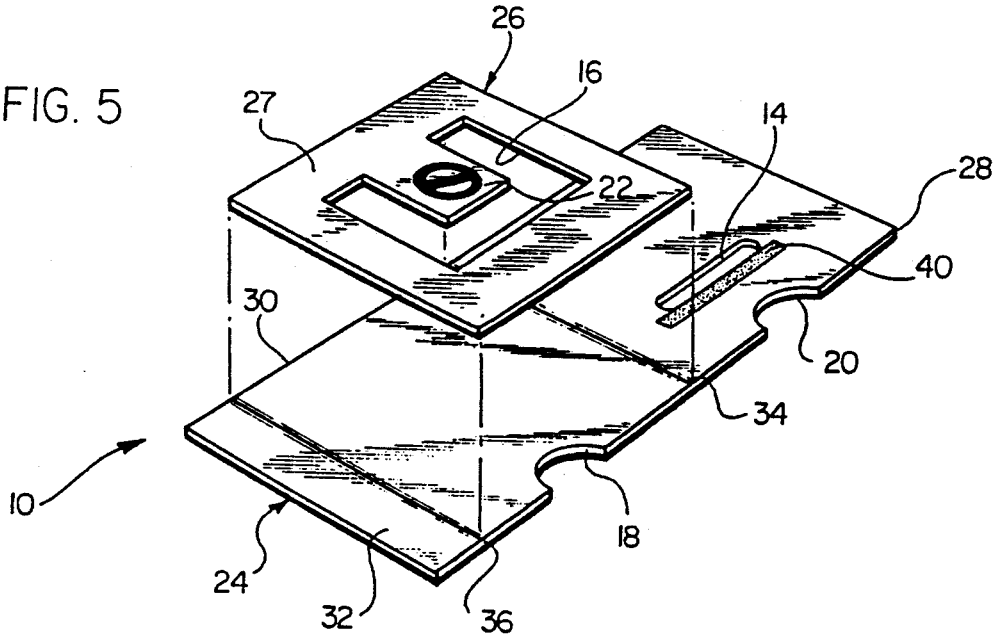
FIG. 5 illustrates the application of a seam of glue to one of the ribbons previously formed and stacked.

Referring next to FIG. 4, the method next proceeds by stacking the ribbons in position for aligning the pop-out member 22 in such a position that it will later be alignable for extension and retraction through the slot 14. This initially involves aligning the ribbons 24, 26 such that the slide panel 27 is immediately over and in alignment with the base panel 30. Referring also to FIG. 5, as now indicated by the alignment of the slide panel 27 with the base panel 30, a further flap portion 32 of the ribbon 30 is also generally defined, which flap portion extends generally to the opposite side of the base panel 30 from slotted panel 28. As will be more fully appreciated presently, the base panel and slotted panel on the one hand, and the base panel and flap 32 on the other hand, define respective fold lines 34, 36 therebetween along which the panels 28, 30 and flap 32 will be folded later.

Figure 6:
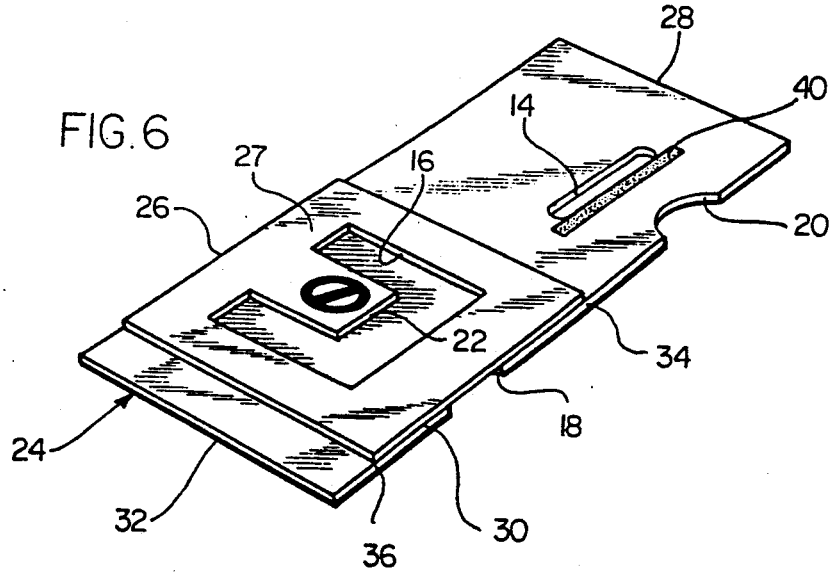
FIG. 6 illustrates the marrying of one ribbon to the other ribbon.
Figure 7:
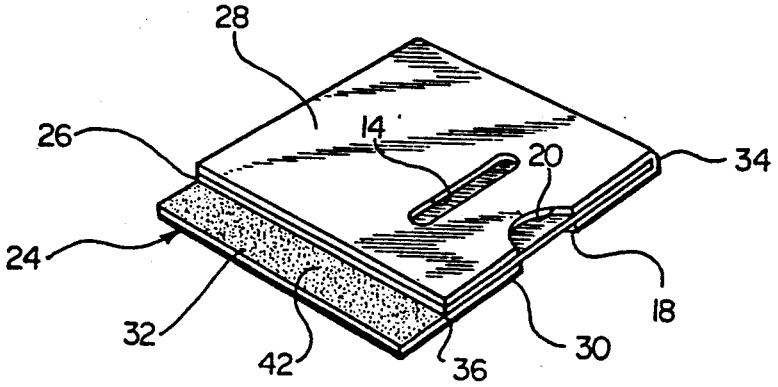
FIG. 7 illustrates the step of folding of one ribbon to partially enclose the other ribbon.

Referring to FIGS. 5 and 6, with the slide panel 27 aligned with the base panel 30, a glue line or seam of glue 40 is deposited on the slotted panel 26 immediately adjacent and running parallel and alongside of the slot 14. It will be seen that the cutout 22 is located such that the seam of glue 40 will engage and adhesively secure against the surface of panel 30 through the cutout 16, when the ribbon carrying the panel 27 is married with the ribbon 24 in alignment with the panel 30. Accordingly, referring to FIG. 7, the ribbon 24 which carries the slot is next folded over upon itself to generally superimpose and align the slotted panel 28 with the base panel 30; that is, ribbon 24 is folded along the fold line 34 previously defined and identified. This folding over partly encloses the ribbon 26; that is, the ribbon 26 is enclosed at its top and bottom surfaces and at its lateral edge which is aligned with the fold line 34 as viewed in FIG. 7.

At this point, the seam of glue 40 will extend through the cutout 16 to contact and adhesively secure with a facing surface of the ribbon 24 and specifically of panel 30, to the other side of the cutout 16.

Figure 8:
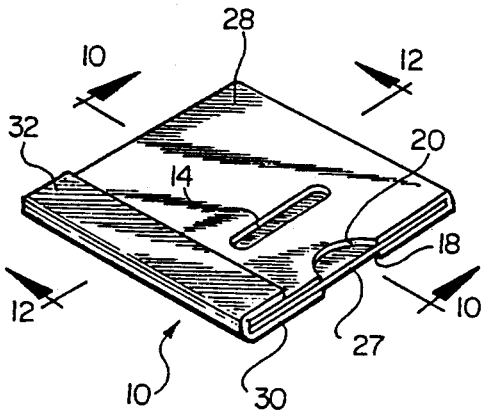
FIG. 8 illustrates a step of folding an outer edge portion or glue flap to completely enclose the one ribbon within the other, and also the slicing or cutting of leading and trailing edges thereof to form an individual pop-out slide member.

Next, as illustrated in FIG. 8, the remaining flap 32 is folded over and adhesively secured, for example by applying a line or spots of glue as indicated by reference numeral 42, to secure the same to the upper or exposed surface of panel 28. This folding is generally along fold line 36, previously defined and identified. This results in the enclosure of the remaining edge part of the ribbon 26 which carries the pop-out member 22.

Figure 9:
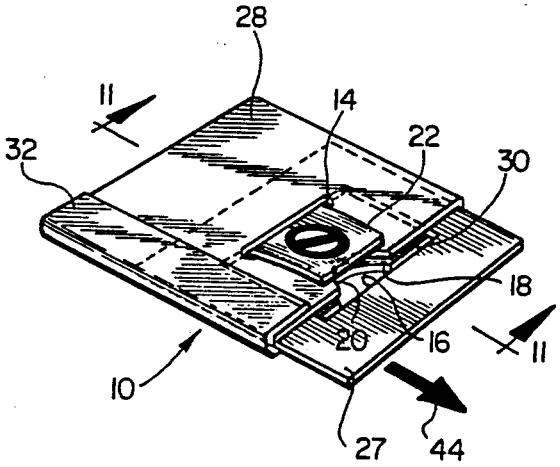
FIG. 9 illustrates the completed pop-out slide with the pop-out member or portion fully extended.

Finally, the individual pop-out slides, which have been formed from the continuous web 10 and the corresponding continuous ribbons 24 and 26 are separated, as by cutting, as illustrated in FIGS. 8 and 9.

Figure 10:
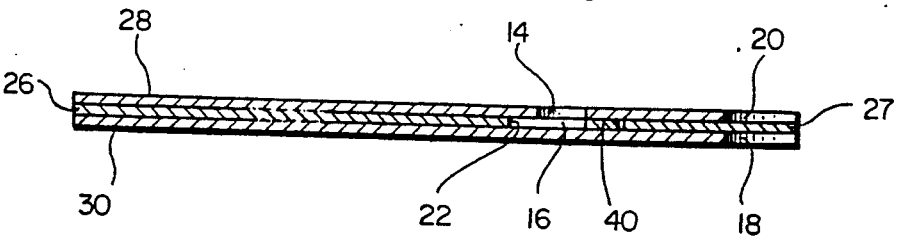
FIG. 10 is a sectional view taken generally along the line 10—10 of FIG. 8.
Figure 11:
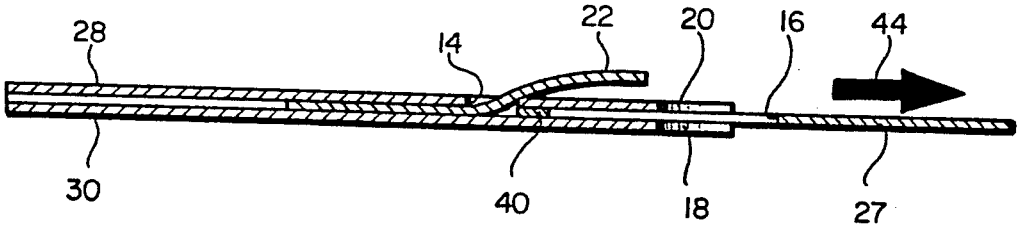
FIG. 11 is a sectional view taken generally along the line 11—11 of FIG. 9.
Figure 12:
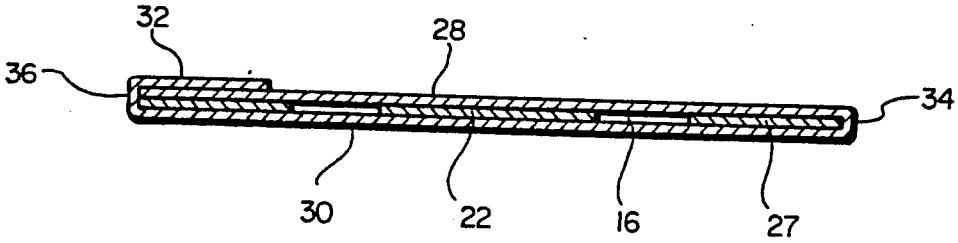
FIG. 12 is a sectional view taken generally along the line 12—12 of FIG. 8.

Referring now also to the remaining figures, it will be seen that the cutout 16 is shaped to generally define the shape of the pop-out member 22, such that the member 22 is appropriately shaped and located for extension and retraction relative to the slot 14 when the pop-out slide is fabricated by the method described hereinabove. Moreover, the glue seam 40 is located and aligned for contacting and engaging the base panel through the cutout 16 when the pop-out slide is fabricated as described hereinabove. Cooperatively, the cutout and pop-out 22 are also formed such that the cutout 22 will initially contact and slide over the glue seam 40 and thus slidably extend through the slot 14 when the slide panel 27 is moved in the direction indicated generally by arrow 44 in FIGS. 9 and 11. The thumb tab cutouts 18 and 20 facilitate gripping of the panel 27 to achieve this motion when the same is fully seated or retracted within the assembly as illustrated, for example, in FIGS. 8 and 10. Conversely, the slide panel 27, when pushed back inwardly of the enclosure formed by the panels 28 and 30, will cause the pop-out member 22 to slidably retract through the slot 14 and into a withdrawn position, retained and hidden between panels 28 and 30, as is illustrated in FIGS. 10 and 12, for example.

Hence the glue line 14 and cutout 16 together define limits of movement of the slide panel within the assembled pop-out slide construction for defining the respective limits of movement of the pop-out member 22, fully extended and fully retracted, relative to slot 14. Similarly, the folding of the panels along fold lines 34 and 36 confine the slidable movement of the slide panel 26 to the direction 44 and the opposite direction. Hence the slide panel 27 cannot be removed once the pop-out slide is fabricated, as described hereinabove, with the glue seam 40 adhesively secured to the base panel portion of the construction as noted hereinabove.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

The invention is claimed as follows:

1. A method of fabricating a pop-out slide from a single continuous web of material comprising the steps of: cutting said web of material to define a through slot and a cutout, such that said cutout in turn defines a pop-out member superimposable with and shaped and alignable for selective extension through said slot; slitting said web into two ribbons, one of said ribbons being a slot-carrying ribbon and the other of said ribbons including said cutout and said pop-out member; stacking said ribbons in a position for aligning said pop-out member with said slot; applying a seam of glue adjacent said slot; marrying the ribbon carrying said pop-out member with the ribbon carrying said slot; folding over a portion of said slot-carrying ribbon so as to partly enclose said ribbon carrying said pop-out member and such that said seam of glue extends through the cutout defining said pop-out member to adhesively secure with a facing surface of said slot-carrying ribbon to the other side thereof.

2. A method according to claim 1, wherein said steps are performed in order.

3. The method of claim 1, wherein the step of folding includes leaving a flap portion of said slot-carrying ribbon extending outwardly when the slot-carrying ribbon is folded over upon itself, and further including the step of applying a line of glue to said outwardly extending flap portion and folding the flap portion back over to adhesively engage an exposed surface portion thereof through which said slot is formed to enclose said ribbon carrying said pop-out member therewithin.

4. The method of claim 1 and further including the step of cutting individual pop-out slides thus formed from said first and second ribbons.

5. The method of claim 1 and further including the initial step of printing upon said web of material.

6. A method according to claim 1 wherein the step of cutting comprises die cutting of said slot and said cutout in said web.

* * * * *